US009409099B2

(12) United States Patent
Sokolov

(10) Patent No.: US 9,409,099 B2
(45) Date of Patent: Aug. 9, 2016

(54) CONSTRACTION KIT ELEMENT (VARIANTS) AND CONSTRACTION KIT

(71) Applicant: Dmitriy Andreyevich Sokolov, Moscow (RU)

(72) Inventor: Dmitriy Andreyevich Sokolov, Moscow (RU)

( * ) Notice: Subject to any disclaimer, the term of this patent is extended or adjusted under 35 U.S.C. 154(b) by 0 days.

(21) Appl. No.: 14/440,667

(22) PCT Filed: Nov. 26, 2013

(86) PCT No.: PCT/RU2013/001062
§ 371 (c)(1),
(2) Date: May 5, 2015

(87) PCT Pub. No.: WO2015/009191
PCT Pub. Date: Jan. 22, 2015

(65) Prior Publication Data

US 2015/0298019 A1 Oct. 22, 2015

(30) Foreign Application Priority Data

Nov. 12, 2013 (RU) ..... 2013150160

(51) Int. Cl.
*A63H 33/08* (2006.01)
*A63H 33/04* (2006.01)
*A63H 33/10* (2006.01)

(52) U.S. Cl.
CPC ..... *A63H 33/04* (2013.01); *A63H 33/08* (2013.01); *A63H 33/084* (2013.01); *A63H 33/086* (2013.01); *A63H 33/088* (2013.01); *A63H 33/105* (2013.01)

(58) Field of Classification Search
CPC ..... A63H 33/04; A63H 33/06; A63H 33/08; A63H 33/084; A63H 33/086; A63H 33/088; A63H 33/10; A63H 33/108
See application file for complete search history.

(56) References Cited

U.S. PATENT DOCUMENTS 6,050,044 A * 4/2000 McIntosh ..... A63H 33/086 446/124
6,648,715 B2 * 11/2003 Wiens et al. ..... A63H 33/062 446/121
7,648,407 B1 * 1/2010 Sorensen ..... A63H 33/084 446/120

FOREIGN PATENT DOCUMENTS

RU 2441686 C2 10/2012
RU 2468848 C1 12/2012
SU 1507411 A1 9/1989

* cited by examiner

*Primary Examiner* — Michael P Ferguson
(74) *Attorney, Agent, or Firm* — Nadya Reingand

(57) ABSTRACT

The invention relates to construction kit elements for use in children's building sets and in puzzles. A construction element according to a first variant comprises a flat rectangular base and a connecting unit. The connecting unit is comprised of four groups of projections. The projections of the first group are tubular and have an annular cross-section. The projections of the second group are tubular and have a square cross-section. The projections of the third group are in the form of rectangular plates with projecting shoulders. In the fourth group the projections are disposed in the corners of the base and are in the form of L-shaped members. A second variant of the construction kit element comprises three of the four groups of projections. The variants of the invention provide construction kit elements with enhanced functional capabilities.

19 Claims, 21 Drawing Sheets

A - A

B - B

C - C

CONSTRACTION KIT ELEMENT (VARIANTS) AND CONSTRACTION KIT

REFERENCE TO RELATED APPLICATIONS

The present application is a National stage application of the PCT application No. PCT/RU2013/001062 filed on Nov. 26, 2013, claiming priority to Russian patent application No. RU2013150160 filed on Nov. 12, 2013.

TECHNICAL FIELD

This invention relates to construction components, and particularly to construction components that can be used both in toy construction sets and puzzles.

BACKGROUND

One known analog from prior art is the construction component from the company "LEGO", containing a base, which is created, as a rule, in the form of a parallelepiped with one or more interlocking joints (patent RU 2150985 of 20 Jun. 2000).

A disadvantage of the known construction component is poor functionality because its design permits only one possible type of connection between identical construction components.

SUMMARY OF THE INVENTION

The object of the claimed invention is to create a construction component which provides many options for interlocking similar components.

The technical result comprises increasing the functional possibilities of the construction component by increasing the connection options of the proposed construction component with other components of the same type and introducing additional elements to provide a movable connection.

The technical result of the first construction component embodiment is achieved due to the construction component containing a base and interlocking joint. The base is made flat and has a rectangular form, with sides made in multiples of <<a>>. The interlocking joint is created by positioning protrusions on the base, which form four groups of protrusions. The first group of protrusions is positioned at least on one side of the base in tubular form, having ring-shaped cross-sections with an outer diameter equal to <<a>>. The height of the protrusions in the first group is greater than <<0.5a>> but no greater than <<a>>. The second group has protrusions positioned on at least one side of the base that are tubular, with cross-sections in the form of a square having side length in the tubular protrusion equal to <<a>>. The height of the protrusions in the second group is equal to <<0.5a>>. In the third group, protrusions are made in the form of rectangular plates, positioned with its midline on the ends of the base, flush with these ends, and having ledges with width equal to <<a>> along the short sides protruding not more than <<0.5a>> from the base ends. The ledges are angled towards each other with the gap formed between their end parts no greater than <<a>>. Protrusions in the fourth group are made in the form of corners, having shelves positioned perpendicular to the base planes on its adjacent ends and flush with these ends. Shelves have a length equal to <<a>> and width no greater than <<0.5a>>. All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid –<<0.5a>>. Protrusions from the first group are positioned at points where the grid lines intersect. Protrusions from the second group are positioned at points where the diagonals of the cells of the coordinate grid intersect. Protrusions from the third group are positioned in the middle between the neighboring protrusions from the first group that are positioned flush with the ends of the base. Protrusions from the fourth group are positioned in the corners of the base.

The technical result according to the first embodiment of the constructor element is achieved by at least one protrusion from the first group having at least one channel on the inner side.

The technical result according to the first embodiment of the constructor element is achieved by at least one protrusion from the first group having at least two channels on the inner side.

The technical result according to the first embodiment of the constructor element is achieved by at least one protrusion from the first group having at least two channels on the inner side, and the channels are made diametrically opposite.

The technical result according to the first embodiment of the constructor element is achieved by at least one protrusion from the first group having at least one channel on the inner side, and at least one channel is made ported.

The technical result of the second construction component embodiment is achieved due to the construction component containing a base and interlocking joint. The base is made flat and has a rectangular form, with at least one side equal to <<a>> and the other a multiple of <<a>>. The interlocking joint is created by positioning protrusions on the base, which form three groups of protrusions. The first group of protrusions is positioned at least on one side of the base in tubular form, having ring-shaped cross-sections with an outer diameter equal to <<a>>. The height of the protrusions in the first group is greater than <<0.5a>> but no greater than <<a>>. The second group has protrusions made in the form of rectangular plates, positioned with its midline on the ends of the base, flush with these ends, and having ledges with width equal to <<a>> along the short sides protruding not more than <<0.5a>> from the base ends. The ledges are angled towards each other with the gap formed between their end parts no greater than <<a>>. Protrusions in the third group are made in the form of corners, having shelves positioned perpendicular to the base planes on its adjacent ends and flush with these ends. Shelves have a length equal to <<a>> and width no greater than <<0.5a>>. All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid –<<0.5a>>. Protrusions from the first group are positioned at points where the grid lines intersect. Protrusions from the second group are positioned in the middle between the neighboring protrusions from the first group that are positioned flush with the ends of the base. Protrusions from the third group are positioned in the corners of the base.

The technical result according to the second embodiment of the constructor element is achieved by at least one protrusion from the first group having at least one channel on the inner side.

The technical result according to the second embodiment of the constructor element is achieved by at least one protrusion from the first group having at least two channels on the inner side.

The technical result according to the second embodiment of the constructor element is achieved by at least one protrusion from the first group having at least two channels on the inner side, and the channels are made diametrically opposite.

The technical result according to the second embodiment of the constructor element is achieved by at least one protrusion from the first group having at least one channel on the inner side, and at least one channel is made ported.

The technical result of the third construction component embodiment is achieved due to the construction component containing a base and interlocking joint. The base is made flat and has a rectangular form, with sides made in multiples of <<a>>. The interlocking joint is created by positioning protrusions on the base, which form four groups of protrusions. The first group of protrusions is positioned at least on one side of the base in cross-shaped cross-section form, where the distance between the opposing ends of the cross is equal to <<a>>, and/or tubular form having ring-shaped cross-sections with an outer diameter equal to <<a>>. The height of the protrusions in the first group is greater than <<0.5a>> but no greater than <<a>>. The second group has protrusions positioned on at least one side of the base that are tubular, with cross-sections in the form of a square having side length in the tubular protrusion equal to <<a>>. The height of the protrusions in the second group is equal to <<0.5a>>. In the third group, protrusions are made in the form of rectangular plates, positioned with its midline on the ends of the base, flush with these ends, and having ledges with width equal to <<a>> along the short sides protruding not more than <<0.5a>> from the base ends. The ledges are angled towards each other with the gap formed between their end parts no greater than <<a>>. Protrusions in the fourth group are made in the form of corners, having shelves positioned perpendicular to the base planes on its adjacent ends and flush with these ends. Shelves have a length equal to <<a>> and width no greater than <<0.5a>>. All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid –<<0.5a>>. Protrusions from the first group are positioned at points where the grid lines intersect. Protrusions from the second group are positioned at points where the diagonals of the cells of the coordinate grid intersect. Protrusions from the third group are positioned in the middle between the neighboring protrusions from the first group that are positioned flush with the ends of the base. Protrusions from the fourth group are positioned in the corners of the base.

The technical result according to the third embodiment of the constructor element is achieved by at least one protrusion with ring-shaped cross-section from the first group having at least one channel on the inner side.

The technical result according to the third embodiment of the constructor element is achieved by at least one protrusion with ring-shaped cross-section from the first group having at least two channels on the inner side.

The technical result according to the third embodiment of the constructor element is achieved by at least one protrusion with ring-shaped cross-section from the first group having at least two channels on the inner side, and the channels are made diametrically opposite.

The technical result according to the third embodiment of the constructor element is achieved by at least one protrusion with ring-shaped cross-section from the first group having at least one channel on the inner side, and at least one channel is made ported.

The technical result of the fourth construction component embodiment is achieved due to the construction component containing a base and interlocking joint. The base is made flat and has a rectangular form, with at least one side equal to <<a>>, the other a multiple of <<a>>. The interlocking joint is created by positioning protrusions on the base, which form three groups of protrusions. The first group of protrusions is positioned at least on one side of the base in cross-shaped cross-section form, where the distance between the opposing ends of the cross is equal to <<a>>, and/or tubular form having ring-shaped cross-sections with an outer diameter equal to <<a>>. The height of the protrusions in the first group is greater than <<a>> but no greater than <<a>>. In the second group, protrusions are made in the form of rectangular plates, positioned with its midline on the ends of the base, flush with these ends, and having ledges with width equal to <<a>> along the short sides protruding not more than <<0.5a>> from the base ends. The ledges are angled towards each other with the gap formed between their end parts no greater than <<a>>. Protrusions in the third group are made in the form of corners, having shelves positioned perpendicular to the base planes on its adjacent ends and flush with these ends. Shelves have a length equal to <<a>> and width no greater than <<0.5a>>. All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid –<<0.5a>>. Protrusions from the first group are positioned at points where the grid lines intersect. Protrusions from the second group are positioned in the middle between the flush neighboring protrusions from the first group. Protrusions from the third group are positioned in the corners of the base.

The technical result according to the fourth embodiment of the constructor element is achieved by at least one protrusion with ring-shaped cross-section from the first group having at least one channel on the inner side.

The technical result according to the fourth embodiment of the constructor element is achieved by at least one protrusion with ring-shaped cross-section from the first group having at least two channels on the inner side.

The technical result according to the fourth embodiment of the constructor element is achieved by at least one protrusion with ring-shaped cross-section from the first group having at least two channels on the inner side, and the channels are made diametrically opposite.

The technical result according to the fourth embodiment of the constructor element is achieved by at least one protrusion with ring-shaped cross-section from the first group having at least one channel on the inner side, and at least one channel is made ported.

The technical result of the constructor is achieved by the constructor containing at least three types of constructor elements, implemented with the ability to connect to one another and form a single construction. Constructor elements of the first type contain a base that is made flat and has a rectangular form, with sides made in multiples of a and an interlocking joint created by positioning protrusions on the base, which form four groups of protrusions. The first group of protrusions is positioned at least on one side of the base in cross-shaped cross-section form, where the distance between the opposing ends of the cross is equal to <<a>>, and/or tubular form having ring-shaped cross-sections with an outer diameter equal to <<a>>. The height of the protrusions in the first group is greater than <<0.5a>> but no greater than <<a>>. The second group has protrusions positioned on at least one side of the base that are tubular, with cross-sections in the form of a square having side length in the tubular protrusion equal to <<a>>. The height of the protrusions in the second group is equal to <<0.5a>>. In the third group, protrusions are made in the form of rectangular plates, positioned with its midline on the ends of the base, flush with these ends, and having ledges with width equal to <<a>> along the short sides protruding not more than <<0.5a>> from the base ends. The ledges are angled towards each other with the gap formed between their end parts no greater than <<a>>. Protrusions in the fourth group are made in the form of corners, having shelves positioned perpendicular to the base planes on its adjacent ends and flush with these ends. Shelves have a length equal to <<a>> and width no greater than <<0.5a>>. All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid –<<0.5a>>. Protrusions from the first group are positioned at points where the grid lines intersect. Protrusions from the second group are positioned at points where the diagonals of the cells of the coordinate grid intersect. Protrusions from the third group are positioned in the middle between the neighboring protrusions from the first group that are positioned flush with the ends of the base. Protrusions from the fourth group are positioned in the corners of the base. When implementing protrusions with cross-shaped cross-section from the first group, the end parts are flush with the base ends. Constructor elements of the second type contain a base that is made flat and has a rectangular form, with at least one side equal to <<a>> and the other a multiple of <<a>>, and an interlocking joint created by positioning protrusions on the base, which form three groups of protrusions. The first group of protrusions is positioned at least on one side of the base in cross-shaped cross-section form, where the distance between the opposing ends of the cross is equal to <<a>>, and/or tubular form having ring-shaped cross-sections with an outer diameter equal to <<a>>. The height of the protrusions in the first group is greater than <<0.5a>> but no greater than <<a>>. In the second group, protrusions are made in the form of rectangular plates, positioned with its midline on the ends of the base, flush with these ends, and having ledges with width equal to <<a>> along the short sides protruding not more than <<0.5a>> from the base ends. The ledges are angled towards each other with the gap formed between their end parts no greater than <<a>>. Protrusions in the third group are made in the form of corners, having shelves positioned perpendicular to the base planes on its adjacent ends and flush with these ends. Shelves have a length equal to <<a>> and width no greater than <<0.5a>>. All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid –<<0.5a>>. Protrusions from the first group are positioned at points where the grid lines intersect. Protrusions from the second group are positioned in the middle between the flush neighboring protrusions from the first group. Protrusions from the third group are positioned in the corners of the base. During implementation of protrusions with cross-shaped cross-section from the first group, the end parts are made flush with the base ends. Elements of the first and/or second type have protrusions with ring-shaped cross-sections from the first group implemented with grooves on the inner side. Constructor elements of the third type are made tubular and/or rod-shaped and are equipped with, at least, one protrusion on a side surface with the ability to longitudinally move constructor elements of the third type into protrusions with ring-shaped cross-section when placing protrusions of constructor elements of the third type into grooves of protrusions with ring-shaped cross-section.

The technical result of the constructor is achieved by making the grooves diametrically opposite.

EXAMPLES OF INVENTION EMBODIMENTS

Figure 1:
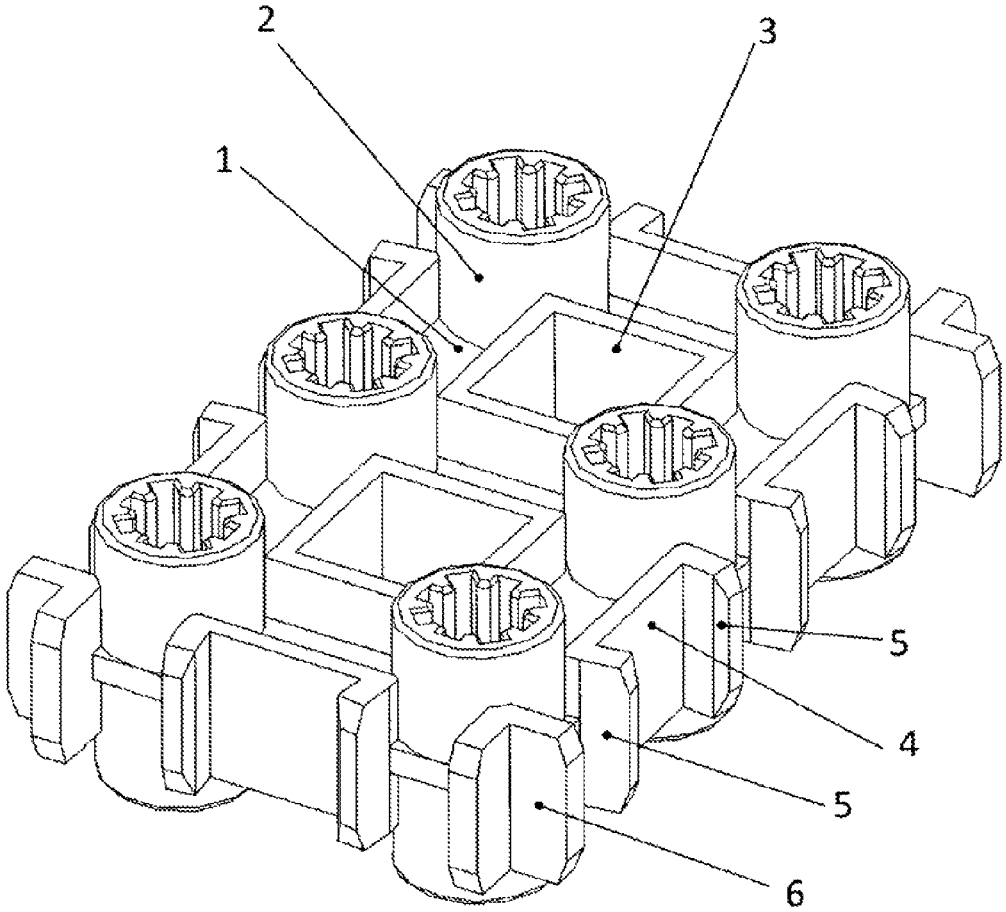
FIG. 1 shows constructor elements according to the first embodiment.

Here we describe a constructor element, according to the first embodiment (see FIG. 1).

Figure 5:
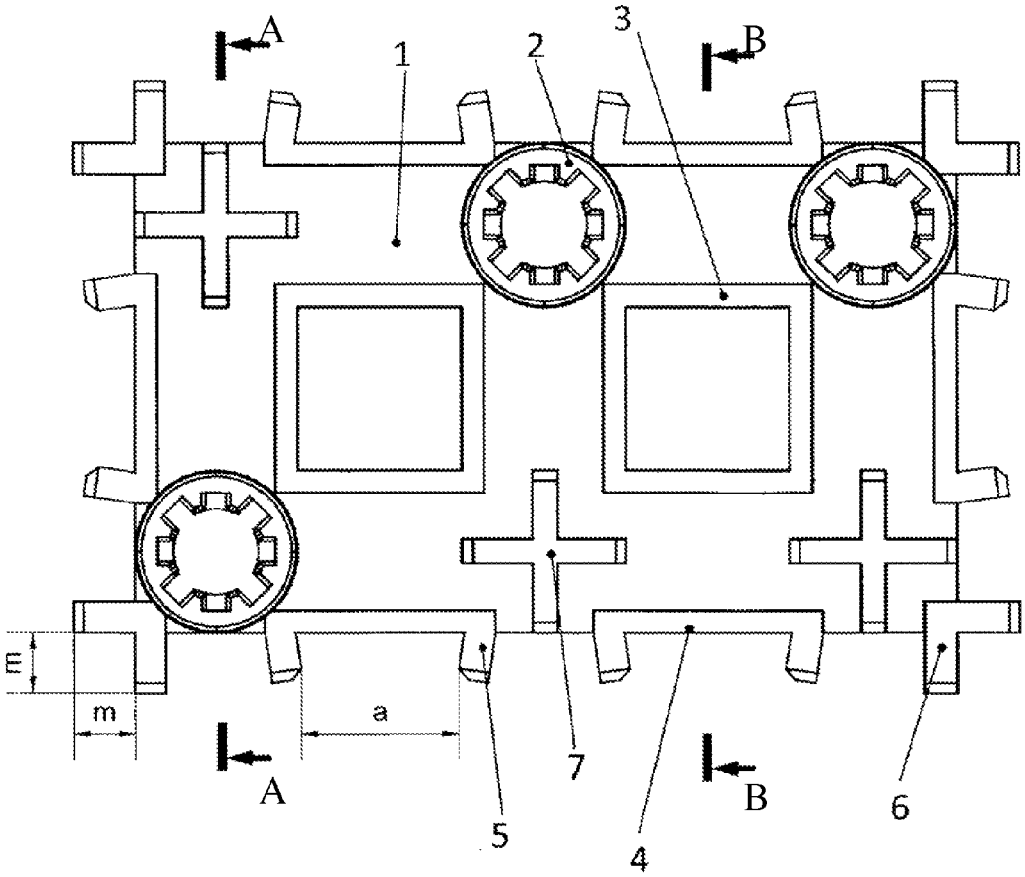
FIG. 5 shows constructor elements implemented according to the third embodiment.
Figure 6:
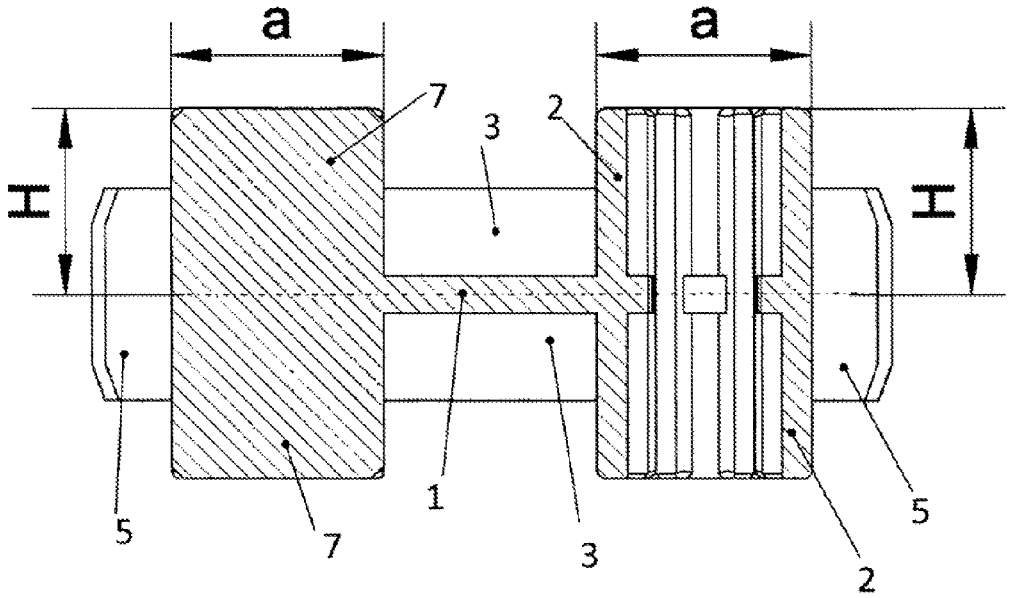
FIG. 6 shows cross-section A-A of FIG. 5.
Figure 7:
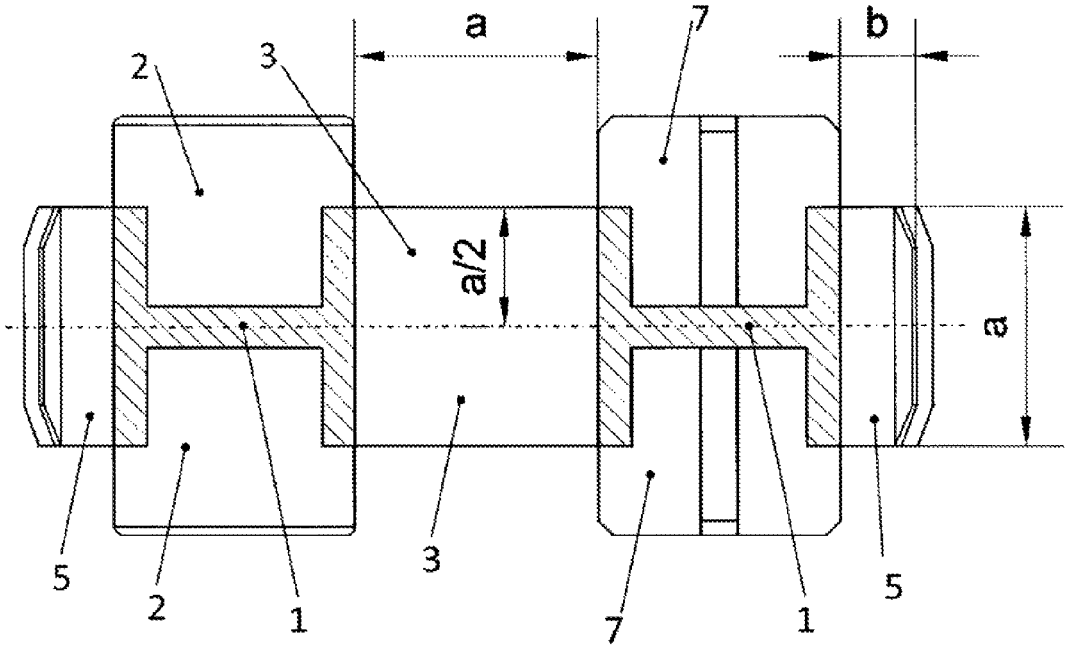
FIG. 7 shows cross-section B-B of FIG. 5.
Figure 8:
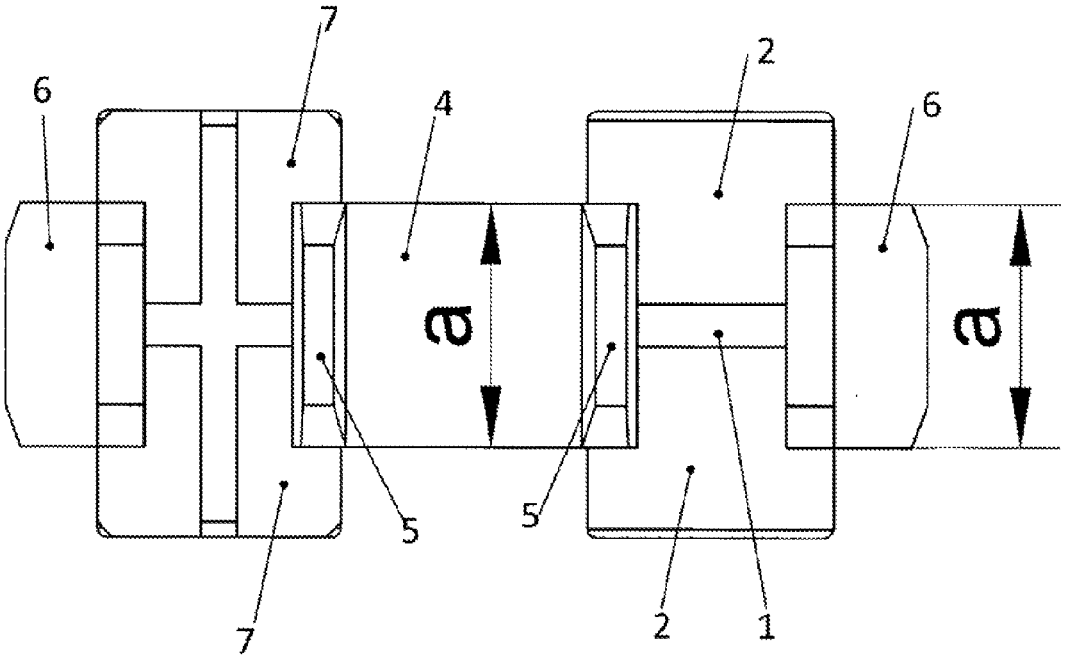
FIG. 8 shows constructor element, implemented according to the third embodiment. Side view.
Figure 9:
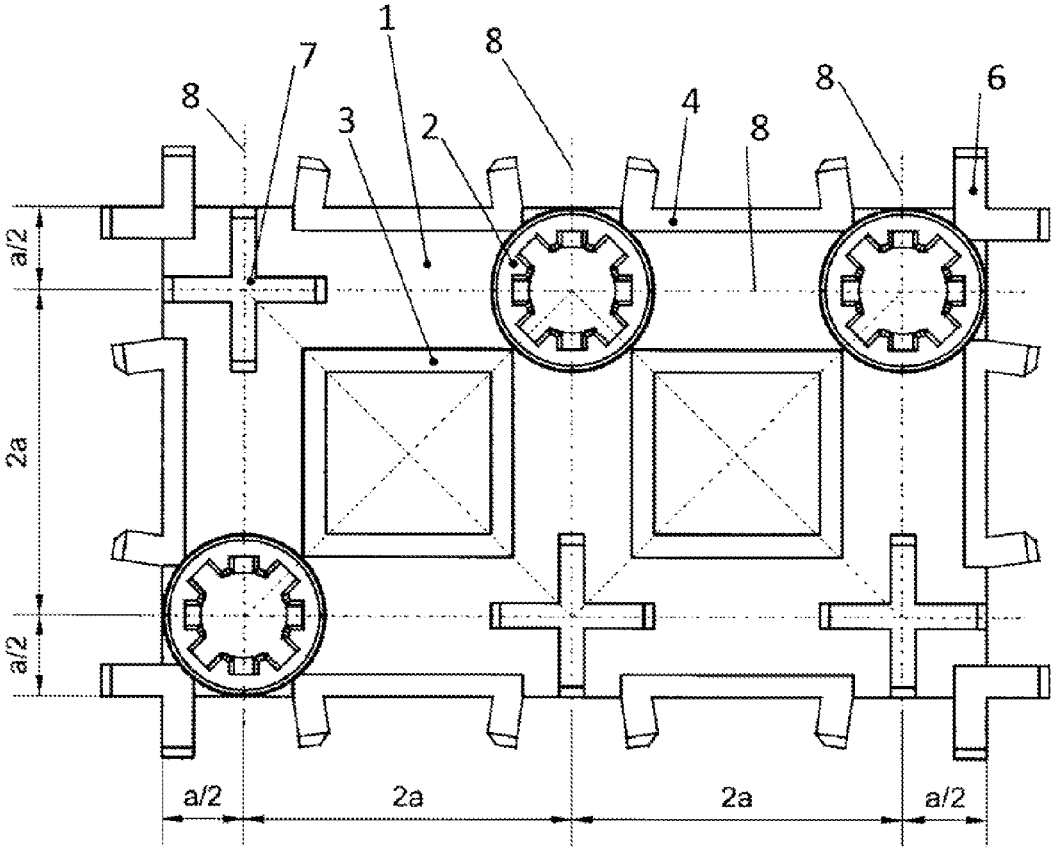
FIG. 9 shows the placement of coordinate grid lines on an example of the constructor element, implemented according to the third embodiment.

Constructor element, according to the first embodiment, contains a base 1, made flat and having a rectangular form, with sides made in multiples of <<a>>, and an interlocking joint, created by positioning protrusions on the base, which form four groups of protrusions. The first group of protrusions 2 is positioned at least on one side of the base 1. The height of the protrusions 2 (see FIG. 6) <<H>> in the first group is greater than <<0.5a>> but no greater than <<a>>. The protrusions are made in tubular form, having ring-shaped cross-sections with an outer diameter equal to <<a>>. The inner side of the ring can be made ported and/or with grooves closed on both ends. The second group has protrusions 3 positioned on at least one side of the base 1. The height of the protrusions 3 in the second group is equal to <<0.5a>> (see FIG. 7). The protrusions 3 are made tubular, with cross-sections in the form of a square having side length in the tubular protrusion equal to <<a>>. In the third group, protrusions 4 are made in the form of rectangular plates, positioned with its midline on the ends of the base 1, and having ledges, flush with these ends, with width equal to <<a>> (see FIG. 8) along the short sides protruding from the base ends by a length "B" (see FIG. 7), which is not more than <<0.5a>>, angled towards each other with the gap formed between their end parts no greater than <<a>> (see FIG. 5). Protrusions 6 in the fourth group are made in the form of corners, having shelves positioned perpendicular to the base 1 planes on its adjacent ends and flush with these ends, with a length equal to <<a>> (see FIG. 8) and width <<d>> (see FIG. 5) no greater than <<0.5a>>. Protrusions are positioned on the base 1 in accordance with the coordinate grid 8 (see FIG. 9) of mutually perpendicular lines parallel to base 1 edges, wherein the distance between neighboring lines of the coordinate grid is equal to <<2a>>, wherein the distance between the base edges and neighboring lines on the coordinate grid –<<0.5a>>. Protrusions 2 from the first group are positioned at points where the coordinate grid 8 lines intersect. Protrusions 3 from the second group are positioned at points where the diagonals of the cells of the coordinate grid 8 intersect. Protrusions 4 from the third group are positioned in the middle between the neighboring protrusions 2 from the first group that are positioned flush with the ends of the base 1. Protrusions 6 from the fourth group are positioned in the corners of the base 1.

Figure 2:
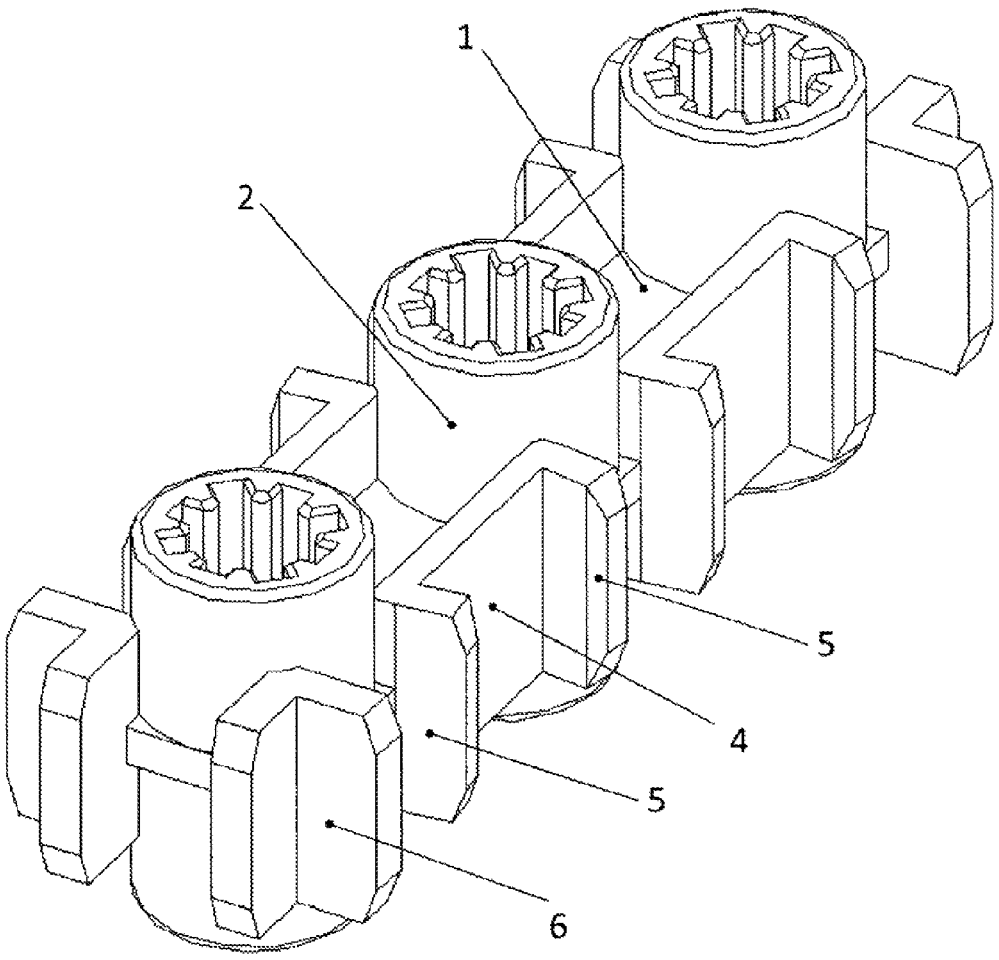
FIG. 2 shows constructor elements according to the second embodiment.

Here we describe a constructor element, according to the second embodiment (see FIG. 2)

Figure 10:
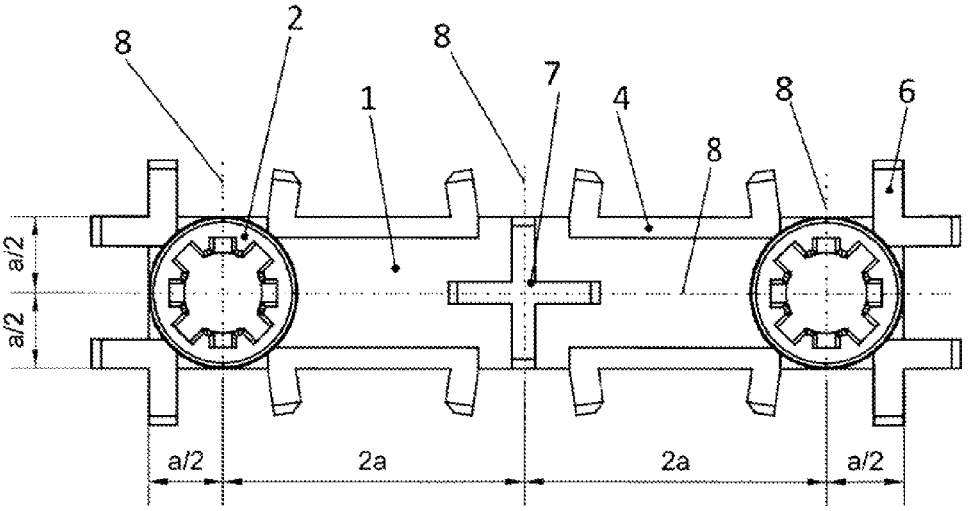
FIG. 10 shows the placement of coordinate grid lines on an example of the constructor element, implemented according to the fourth embodiment.

Constructor element, according to the second embodiment, contains a base 1, made flat and having a rectangular form, with at least one side equal to <<a>>, the other a multiple of <<a>>, and an interlocking joint, created by positioning protrusions on the base, which form three groups of protrusions. The first group of protrusions 2 is positioned at least on one side of the base 1. The height of the protrusions 2 (see FIG. 6) <<H>> in the first group is greater than <<0.5a>> but no greater than <<a>>. The protrusions are made in tubular form, having ring-shaped cross-sections with an outer diameter equal to <<a>>. The inner side of the ring can be made ported and/or with grooves closed on both ends. In the second group, protrusions 4 are made in the form of rectangular plates, positioned with its midline on the ends of the base 1, and having ledges, flush with these ends, with width equal to <<a>> (see FIG. 8) along the short sides protruding from the base ends by a length "B" (see FIG. 7), which is not more than <<0.5a>>, angled towards each other with the gap formed between their end parts no greater than <<a>> (see FIG. 5). Protrusions 6 in the third group are made in the form of corners, having shelves positioned perpendicular to the base 1 planes on its adjacent ends and flush with these ends, with a length equal to <<a>> (see FIG. 8) and width <<d>> (see FIG. 5) no greater than <<0.5a>>. Protrusions are positioned on the base 1 in accordance with the coordinate grid 8 (see FIG. 10) of mutually perpendicular lines parallel to base 1 edges, wherein the distance between neighboring lines of the coordinate grid is equal to <<2a>>, wherein the distance between the base edges and neighboring lines on the coordinate grid –<<0.5a>>. Protrusions 2 from the first group are positioned at points where the coordinate grid 8 lines intersect. Protrusions 4 from the second group are positioned in the middle between the neighboring protrusions 2 from the first group that are positioned flush with the ends of the base 1. Protrusions 6 from the third group are positioned in the corners of the base 1.

Figure 3:
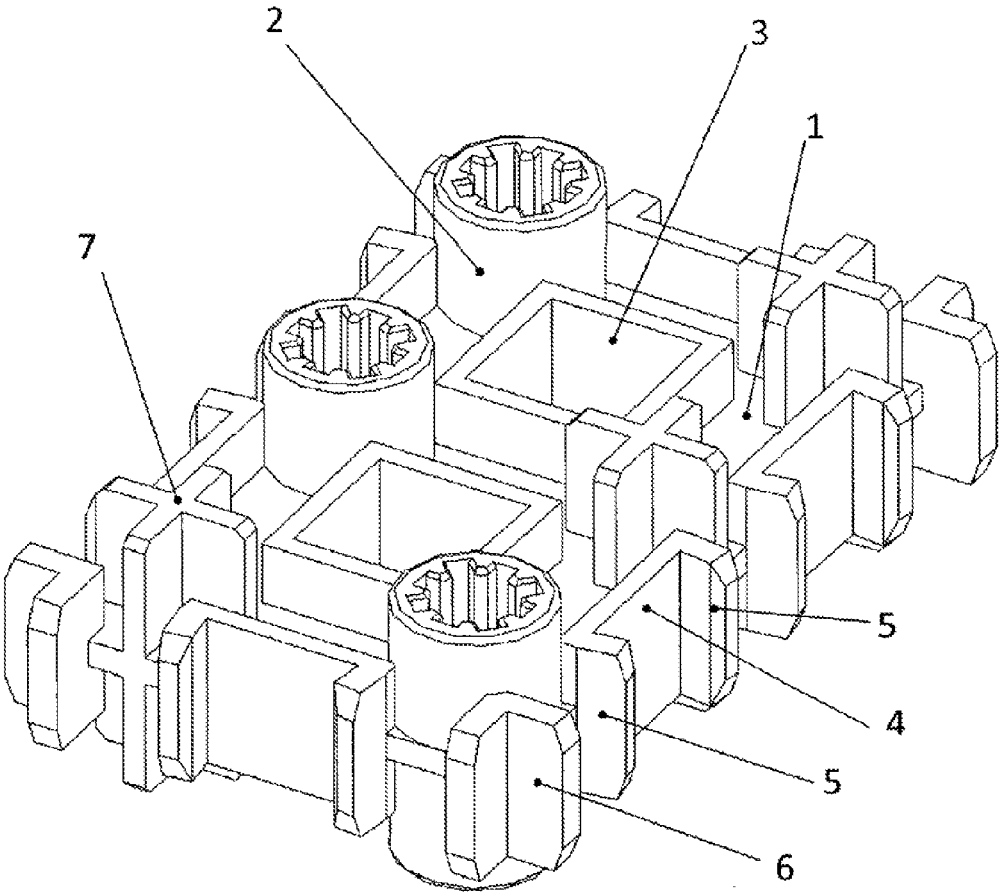
FIG. 3 shows constructor elements according to the third embodiment.

Here we describe a constructor element, according to the third embodiment (see FIG. 3).

Constructor element, according to the third embodiment, contains a base 1, made flat and having a rectangular form, with sides made a multiple of <<a>>, and an interlocking joint, created by positioning protrusions on the base, which form four groups of protrusions. The first group of protrusions 2 and 7 positioned at least on one side of the base 1. The height of protrusions 2 and 7 (see FIG. 6) <<H>> is greater than <<0.5a>> but no greater than <<a>>. Protrusions from the first group are made in the form of protrusions 7 with cross-shaped cross-section form, where the distance between the opposing ends of the cross is equal to <<a>>, and/or protrusions 2 with tubular form having ring-shaped cross-sections with an outer diameter equal to <<a>>. The inner side of the ring can be made ported and/or with grooves closed on both ends. The second group has protrusions 3 positioned on at least one side of the base 1. The height of the protrusions 3 in the second group is equal to <<0.5a>> (see FIG. 7). The protrusions 3 are made tubular, with cross-sections in the form of a square having side length in the tubular protrusion equal to <<a>>. In the third group, protrusions 4 are made in the form of rectangular plates, positioned with its midline on the ends of the base 1, and having ledges, flush with these ends, with width equal to <<a>> (see FIG. 8) along the short sides protruding from the base ends by a length "B" (see FIG. 7), which is not more than <<0.5a>>, angled towards each other with the gap formed between their end parts no greater than <<a>> (see FIG. 5). Protrusions 6 in the fourth group are made in the form of corners, having shelves positioned perpendicular to the base 1 planes on its adjacent ends and flush with these ends, with a length equal to <<a>> (see FIG. 8) and width <<t>> (see FIG. 5) no greater than <<0.5a>>. Protrusions are positioned on the base 1 in accordance with the coordinate grid 8 (see FIG. 9) of mutually perpendicular lines parallel to base 1 edges, wherein the distance between neighboring lines of the coordinate grid is equal to <<2a>>, wherein the distance between the base edges and neighboring lines on the coordinate grid –<<0.5a>>. Protrusions 2 from the first group are positioned at points where the coordinate grid 8 lines intersect. Protrusions 3 from the second group are positioned at points where the diagonals of the cells of the coordinate grid 8 intersect. Protrusions 4 from the third group are positioned in the middle between the neighboring protrusions 2 from the first group that are positioned flush with the ends of the base 1. Protrusions 6 from the fourth group are positioned in the corners of the base 1.

Figure 4:
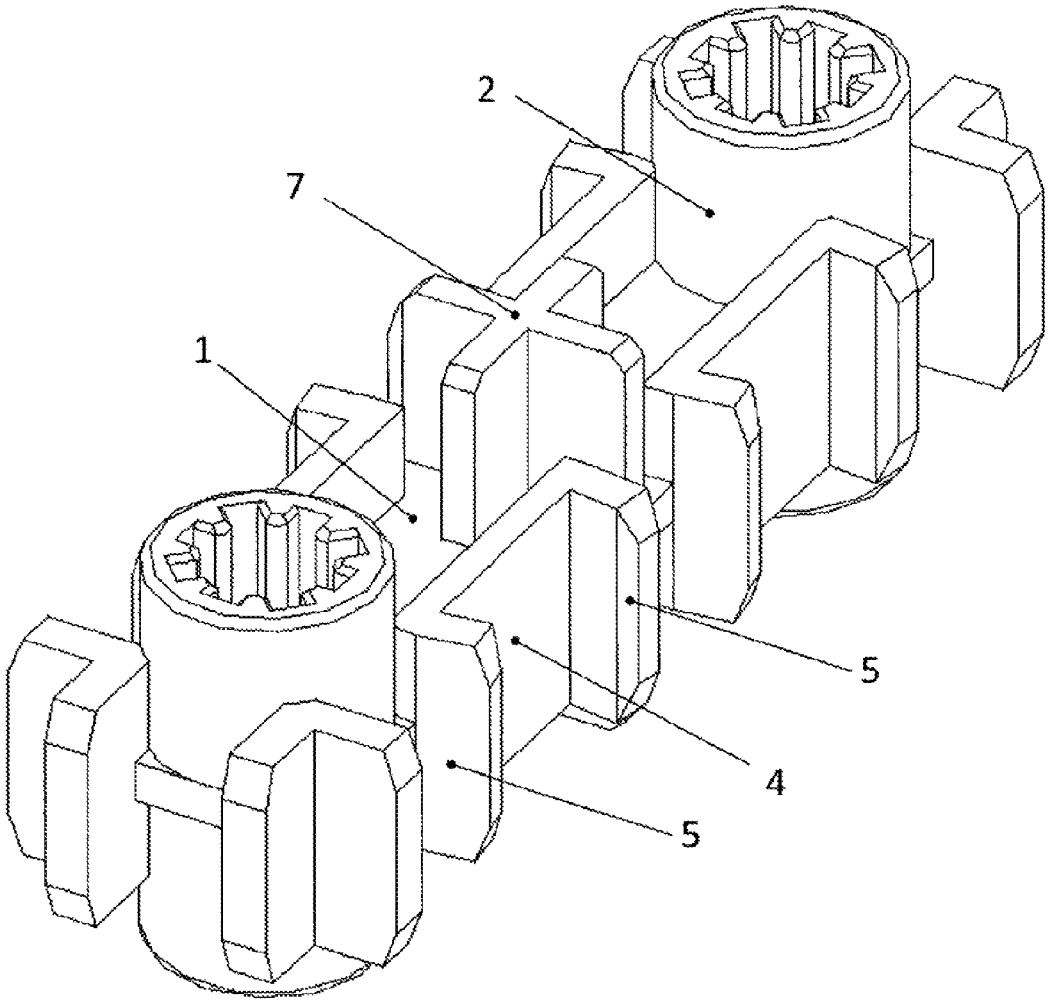
FIG. 4 shows constructor elements according to the fourth embodiment.

Here we describe a constructor element, according to the fourth embodiment (see FIG. 4).

Constructor element, according to the fourth embodiment, contains a base 1, made flat and having a rectangular form, with at least one side equal to <<a>>, the other a multiple of <<a>>, and an interlocking joint, created by positioning protrusions on the base, which form three groups of protrusions. The first group of protrusions 2 and 7 positioned at least on one side of the base 1. The height of protrusions 2 and 7 (see FIG. 6) <<H>> is greater than <<0.5a>> but no greater than <<a>>. Protrusions from the first group are made in the form of protrusions 7 with cross-shaped cross-section form, where the distance between the opposing ends of the cross is equal to <<a>>, and/or protrusions 2 with tubular form having ring-shaped cross-sections with an outer diameter equal to <<a>>. The inner side of the ring can be made ported and/or with grooves closed on both ends. In the second group, protrusions 4 are made in the form of rectangular plates, positioned with its midline on the ends of the base 1, and having ledges, flush with these ends, with width equal to <<a>> (see FIG. 8) along the short sides protruding from the base ends by a length "B" (see FIG. 7), which is not more than <<0.5a>>, angled towards each other with the gap formed between their end parts no greater than <<a>> (see FIG. 5). Protrusions 6 in the third group are made in the form of corners, having shelves positioned perpendicular to the base 1 planes on its adjacent ends and flush with these ends, with a length equal to <<a>> (see FIG. 8) and width <<d>> (see FIG. 5) no greater than <<0.5a>>. Protrusions are positioned on the base 1 in accordance with the coordinate grid 8 (see FIG. 10) of mutually perpendicular lines parallel to base 1 edges, wherein the distance between neighboring lines of the coordinate grid is equal to <<2a>>, wherein the distance between the base edges and neighboring lines on the coordinate grid –<<0.5a>>. Protrusions 2 from the first group are positioned at points where the coordinate grid 8 lines intersect. Protrusions 4 from the second group are positioned in the middle between the neighboring protrusions 2 from the first group that are positioned flush with the ends of the base 1. Protrusions 6 from the third group are positioned in the corners of the base 1.

When connecting constructor elements to one another, the protrusions of different elements interlock with each other. Interlocking is based on the force of friction, occurring between protrusions during close contact with each other. When connecting elements to one another, the protrusions of different groups simultaneously engage in interlocking, which provides improved connection strength.

Let's consider examples of such connections.

Figure 11:
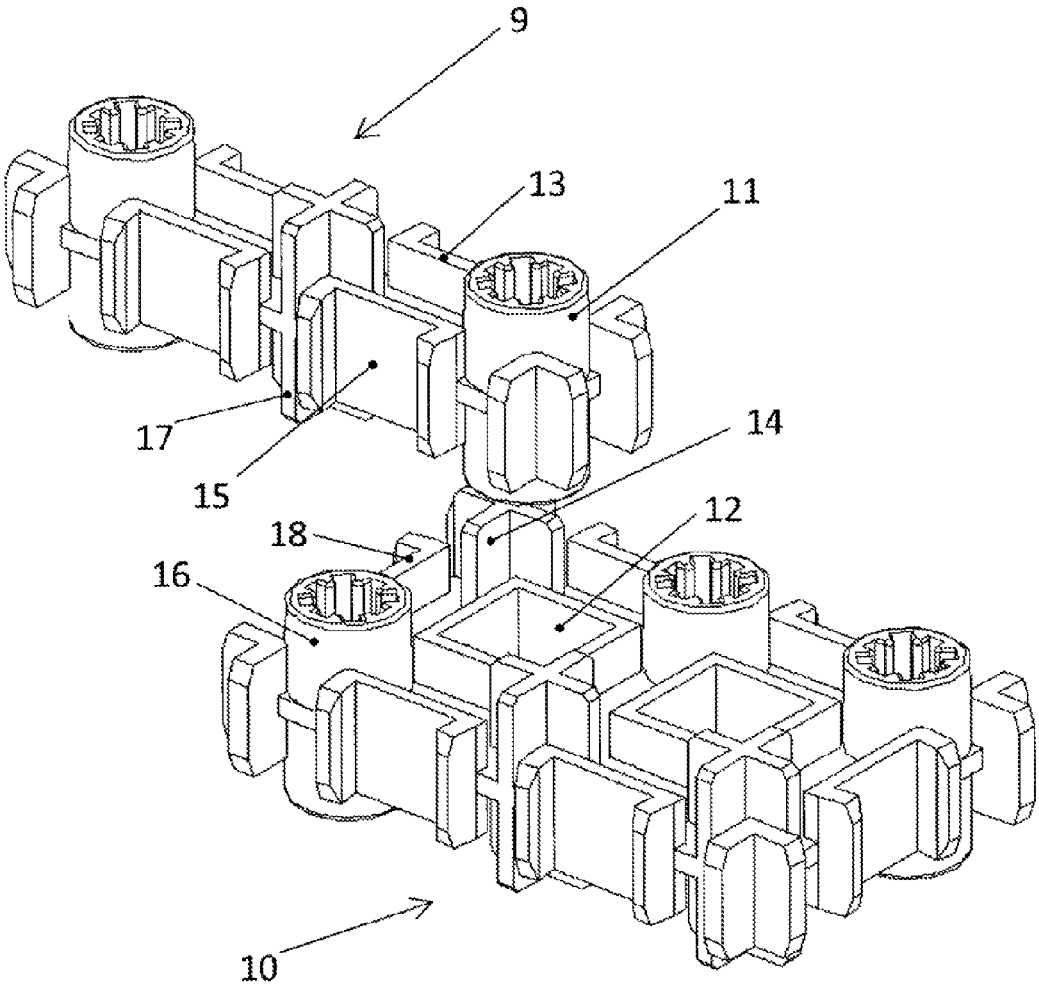
FIG. 11 shows two constructor elements before interlocking.
Figure 12:
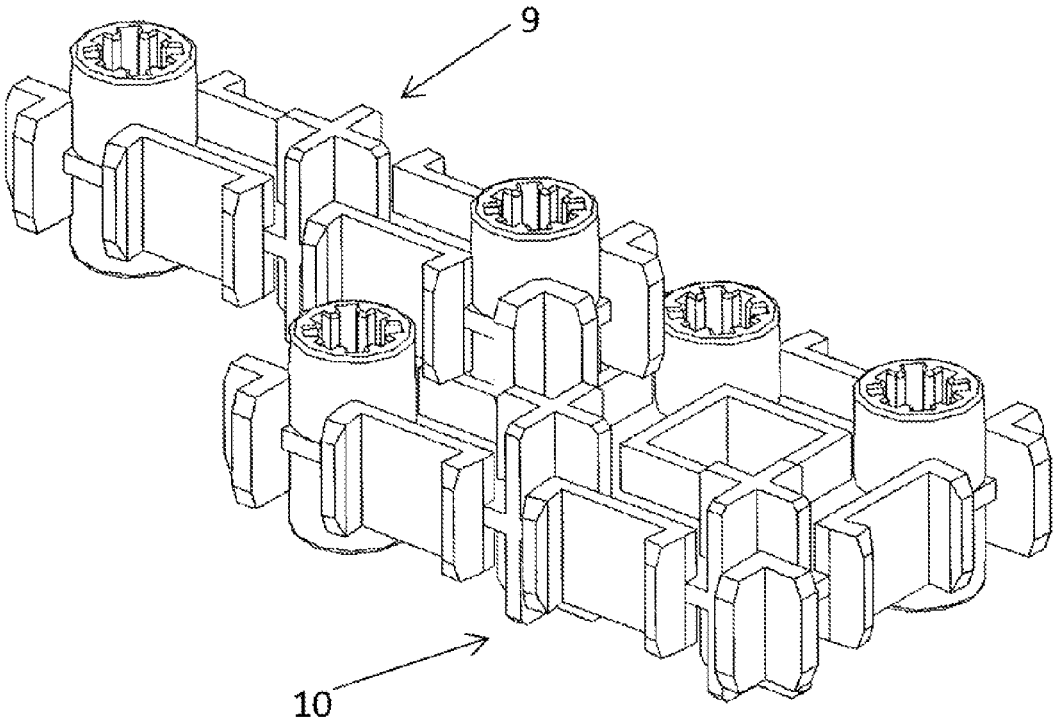
FIG. 12 shows two constructor elements, connected to one another.

FIG. 11 shows two constructor elements prior to connecting, with protrusions entering into interlock with each other indicated. The top element 9 is implemented according to the fourth embodiment and the lower element 10 is implemented according to the third embodiment. A protrusion 11 from the first group of element 9 enters into interlock with protrusion 12 of the second group of element 10. Protrusion 13 from the second group of element 9 enters into interlock with protrusion 14 from the first group of element 10. Protrusion 15 from the second group of element 9 enters into interlock with protrusion 16 from the first group of element 10. Protrusion 17 from the first group of element 9 enters into interlock with protrusion 18 from the third group of element 10. FIG. 12 shows these elements in an interlocked state.

Figure 13:
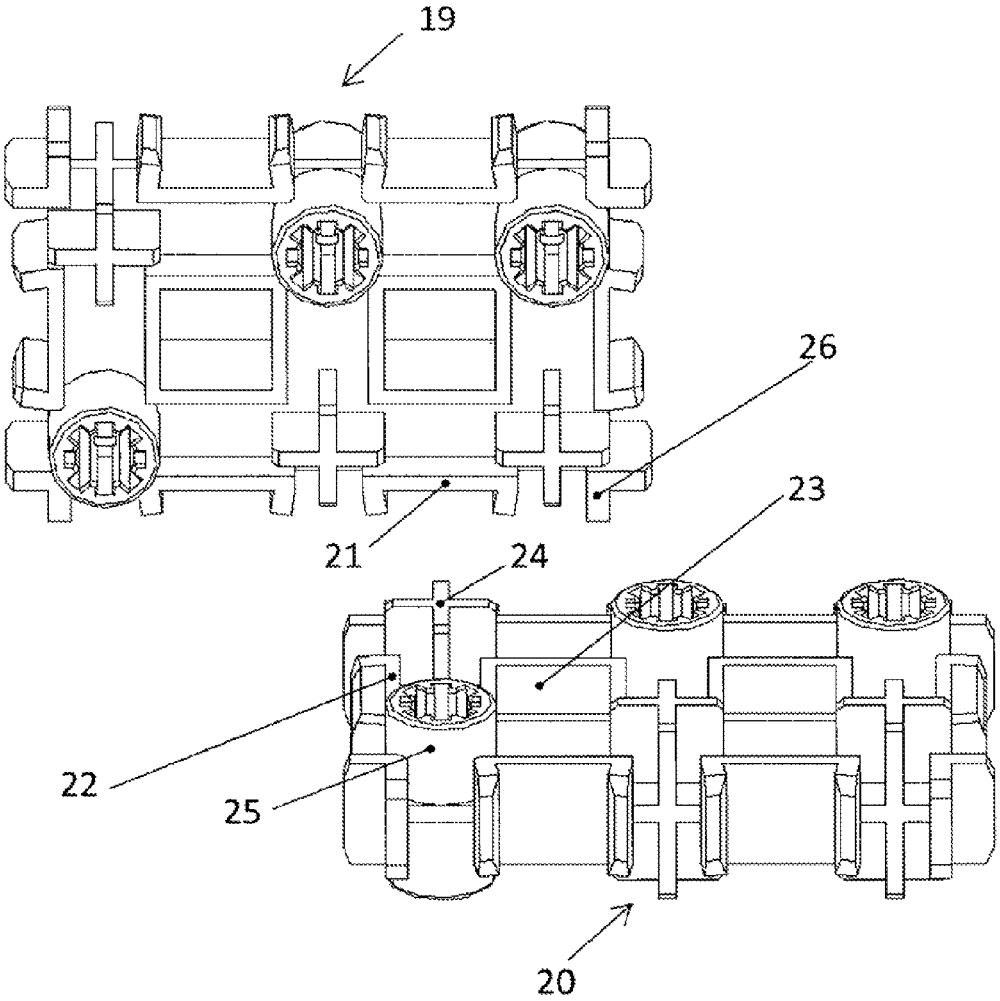
FIG. 13 shows two constructor elements before interlocking.
Figure 14:
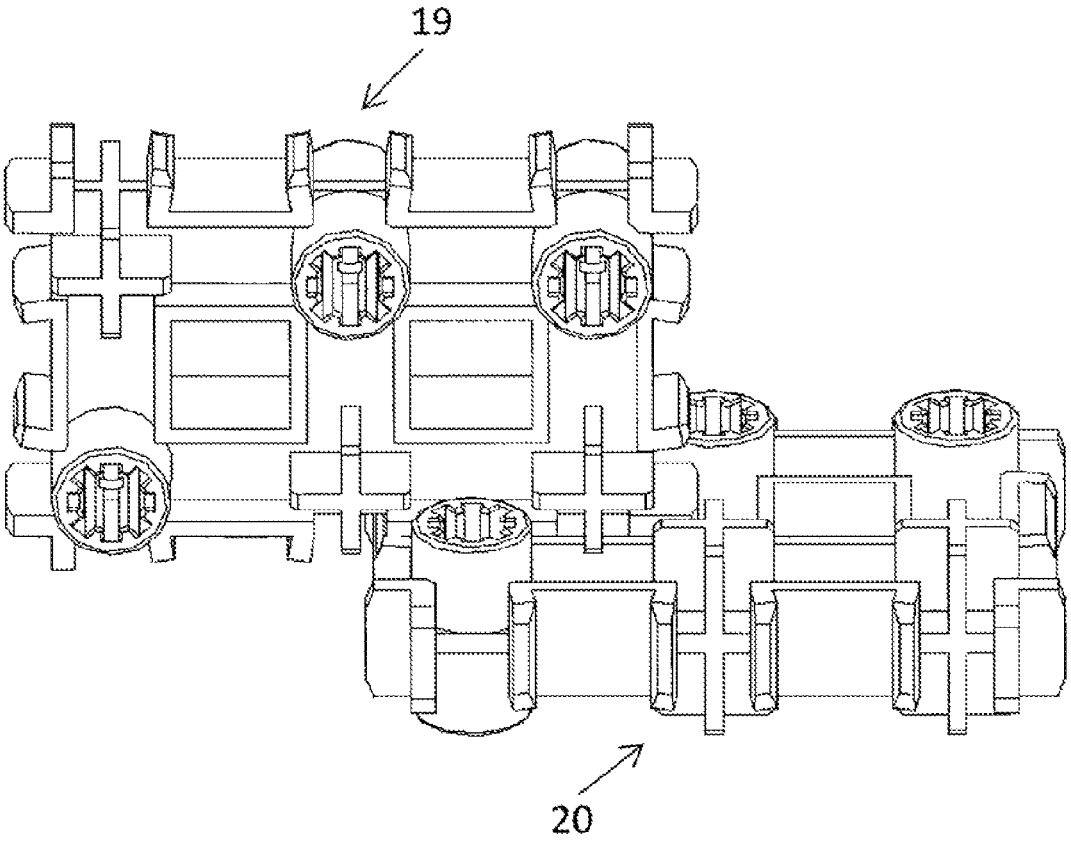
FIG. 14 shows two constructor elements, connected to one another.

FIG. 13 shows two constructor elements 19 and 20 prior to connecting, with indicated protrusions entering into interlock with each other upon connection. Both elements are implemented according to the third embodiment. Protrusion 21 from the third group of element 19 enters into interlock with four protrusions of element 20: protrusion 22 from the third group, protrusion 23 from the second group, protrusion 24 from the first group, and protrusion 25 from the first group. Protrusion 23 from the second group of element 20 enters into interlock with protrusion 26 from the fourth group of element 19. FIG. 14 shows these elements in an interlocked state.

Figure 15:
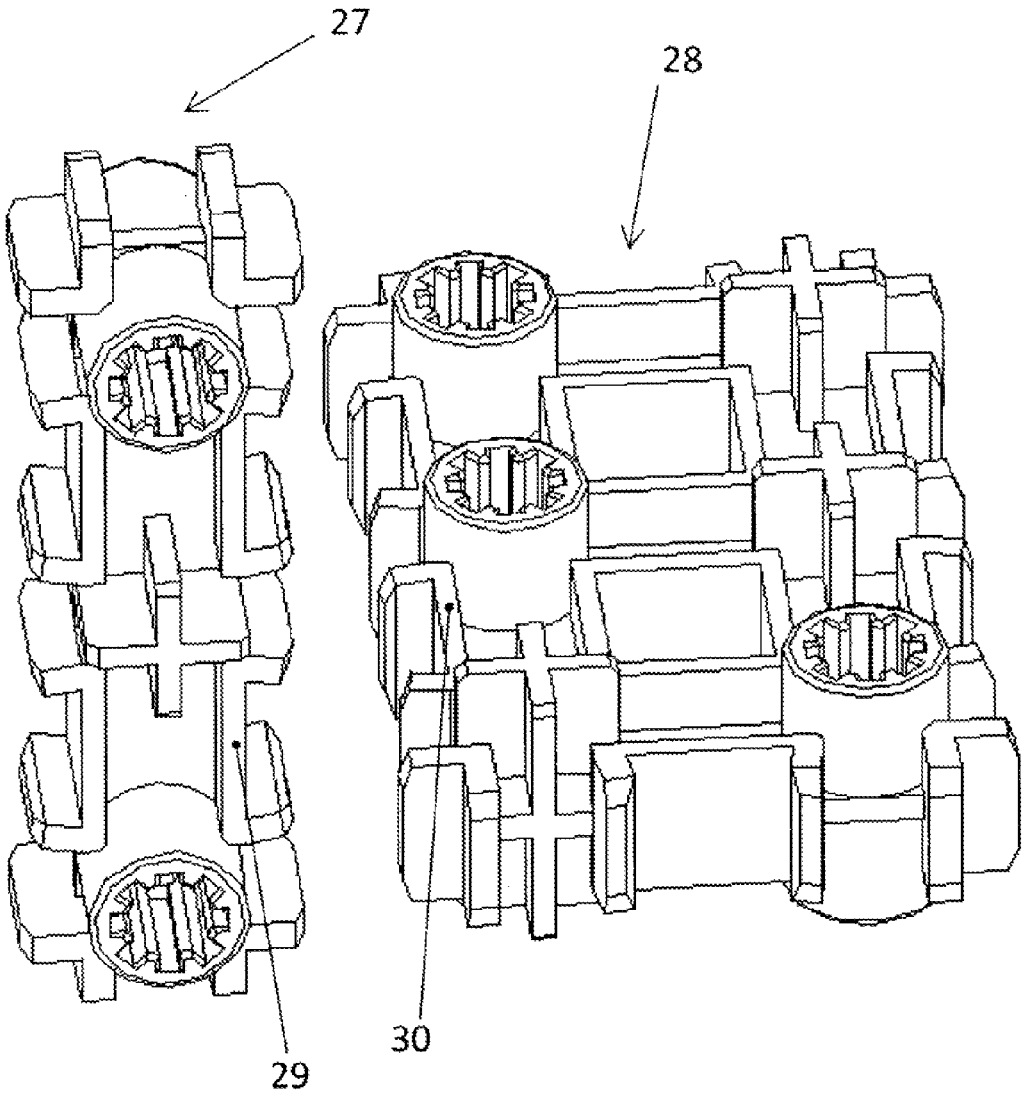
FIG. 15 shows two constructor elements before interlocking.
Figure 16:
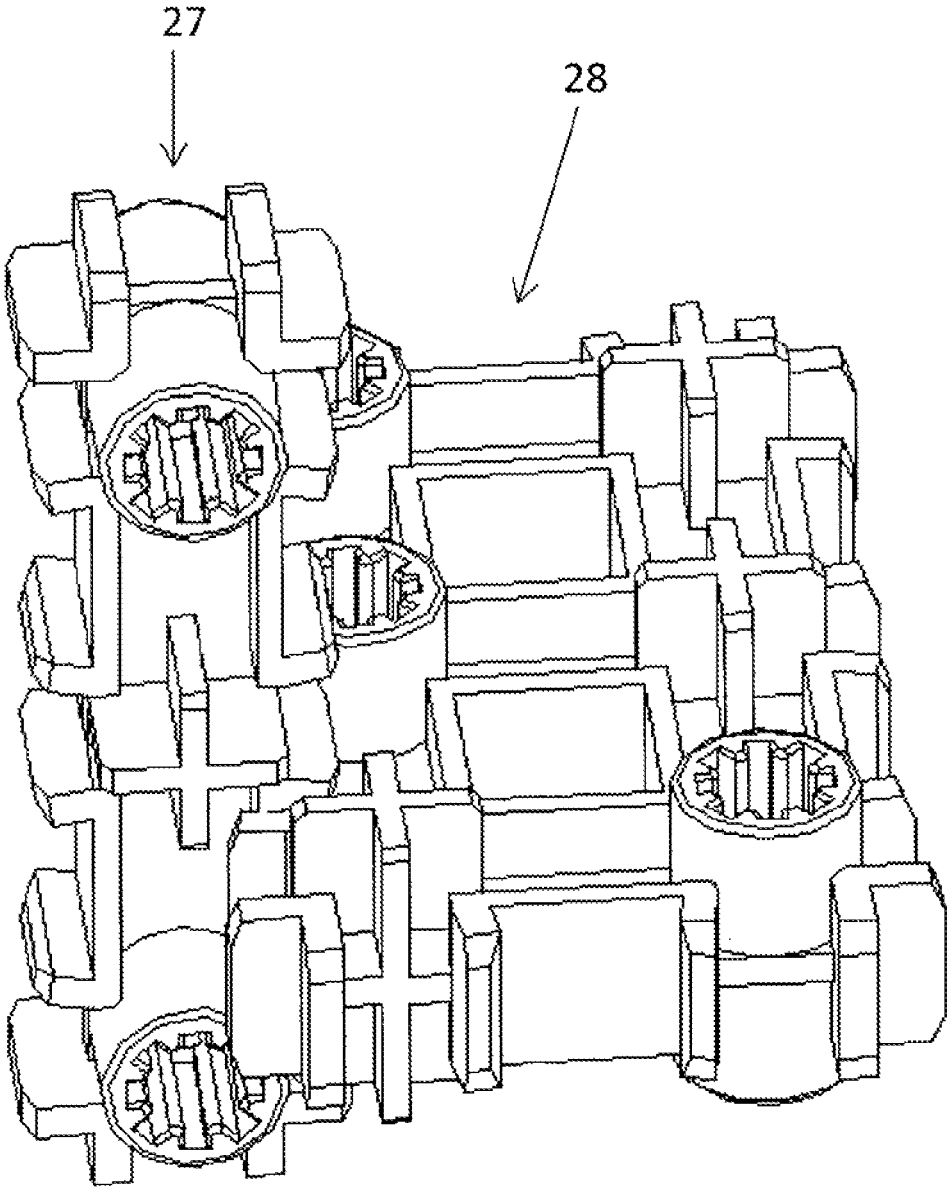
FIG. 16 shows two constructor elements, connected to one another.

FIG. 15 shows two constructor elements prior to connecting with indicated protrusions entering into interlock with each other upon connection. Constructor element 27 is implemented according to the fourth embodiment, and element 28 is implemented according to the third embodiment. Protrusion 29 from the second group of element 27 enters into interlock with protrusion 30 from the third group of element 30. FIG. 16 shows these elements in an interlocked state.

Figure 18:
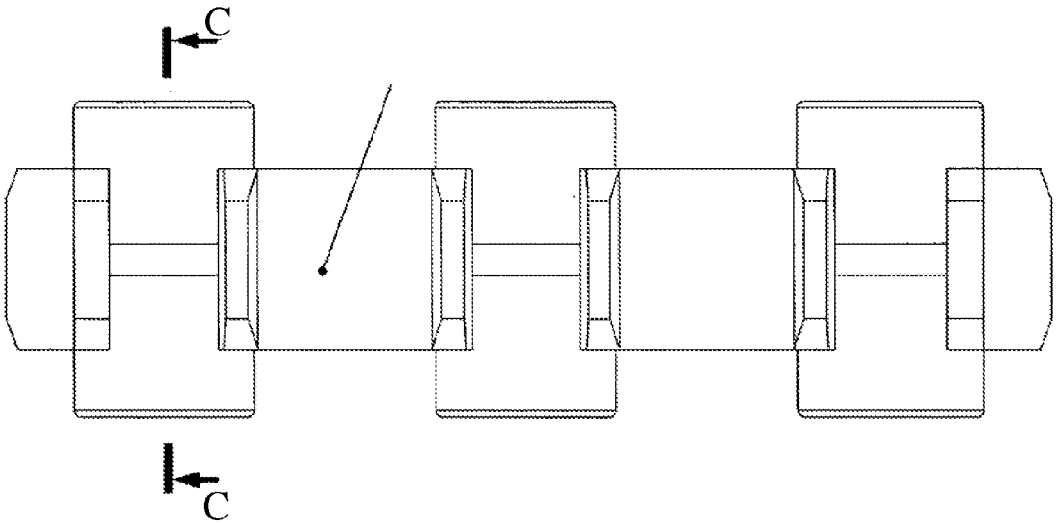
FIG. 18 shows constructor elements of the second embodiment.
Figure 19:
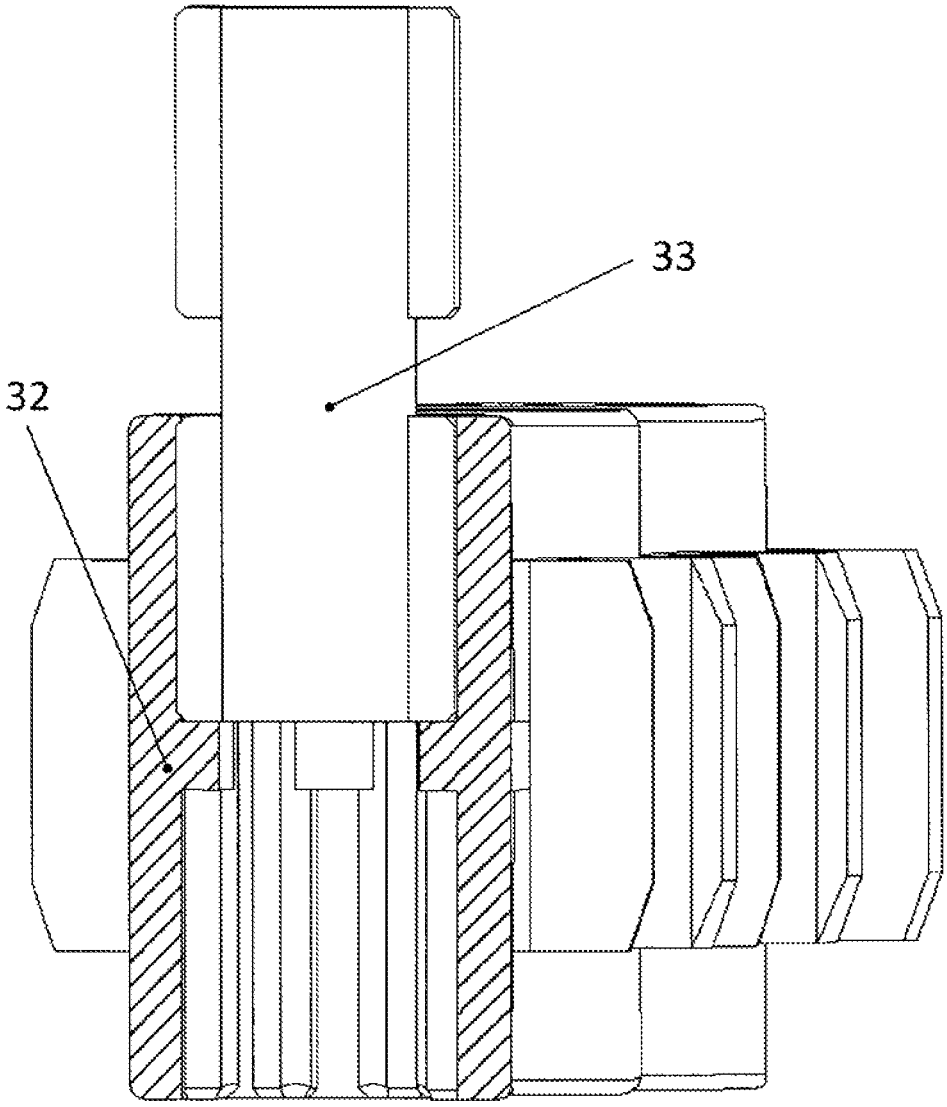
FIG. 19 shows constructor element of the second embodiment with cross-section C-C of FIG. 18, with two protrusions of constructor elements of the third type placed into grooves of protrusions of the first group.

The constructor is characterized by the set of three types of elements it comprises. The first type of constructor element is analogous to constructor elements, implemented according to the first or third embodiments (see position 31 on FIG. 17). The second type of constructor element (see position 32 on FIG. 18) is analogous to constructor elements, implemented according to the second and fourth embodiments (see FIG. 18). The third type of constructor element 33 (see FIGS. 17,19) is made tubular and/or rod-shaped and are equipped with, at least, one protrusion on a side surface with the ability to longitudinally move constructor elements of the third type into protrusions with ring-shaped cross-section when placing protrusions of constructor elements of the third type into protrusions with ring-shaped cross-sections from the first group of elements of the first 31 or second 32 type (see FIGS. 17,19) when placing protrusions of constructor elements of the third type into grooves of protrusions with ring-shaped cross-section. FIG. 19 shows the placement of element 33 of the third type into the closed grooves of the protrusion from the first group of element 32 of the second type. The protrusion is shown in cross-section, so the closed grooves can be seen.

Figure 17:
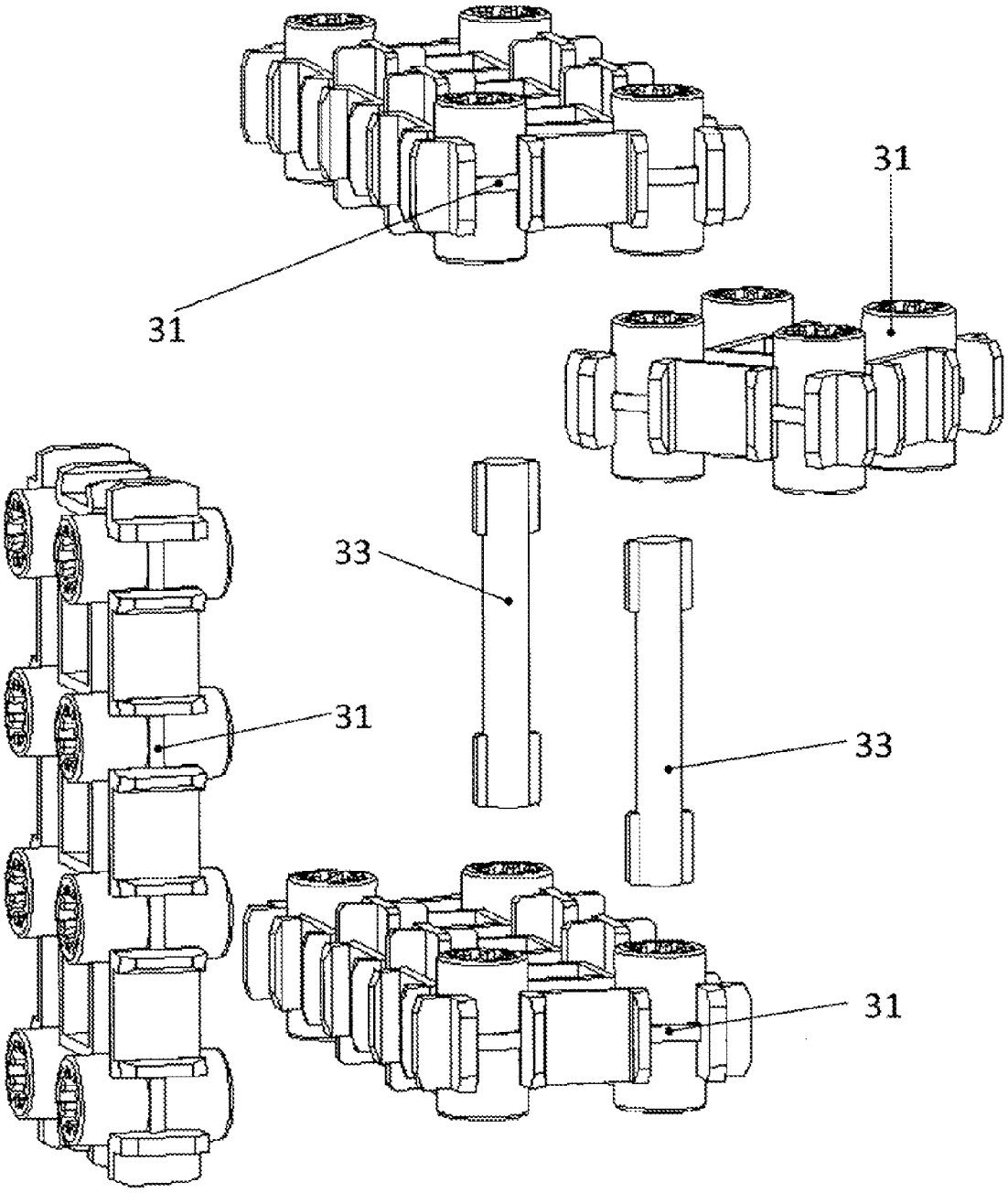
FIG. 17 shows constructor elements prior to assembly.
Figure 20:
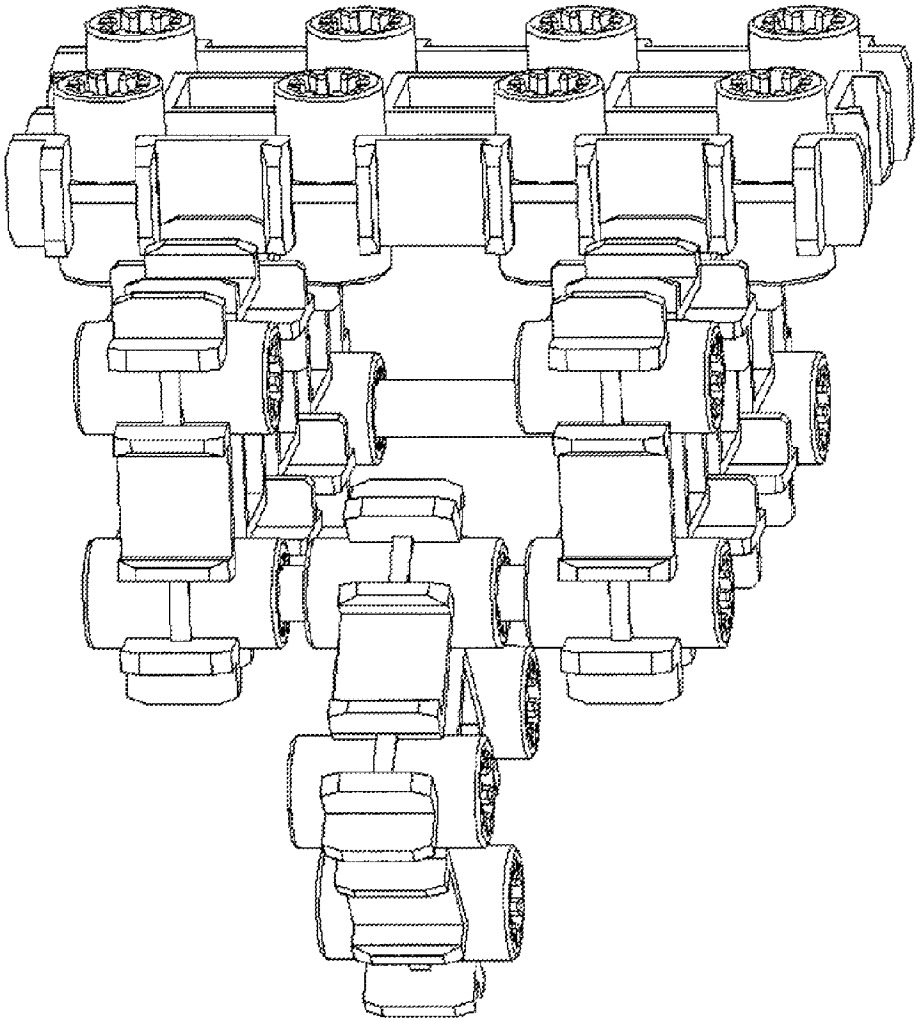
FIGS. 20 and 21 show a construction, assembled from constructor elements, shown in FIG. 17, from various sides.
Figure 21:
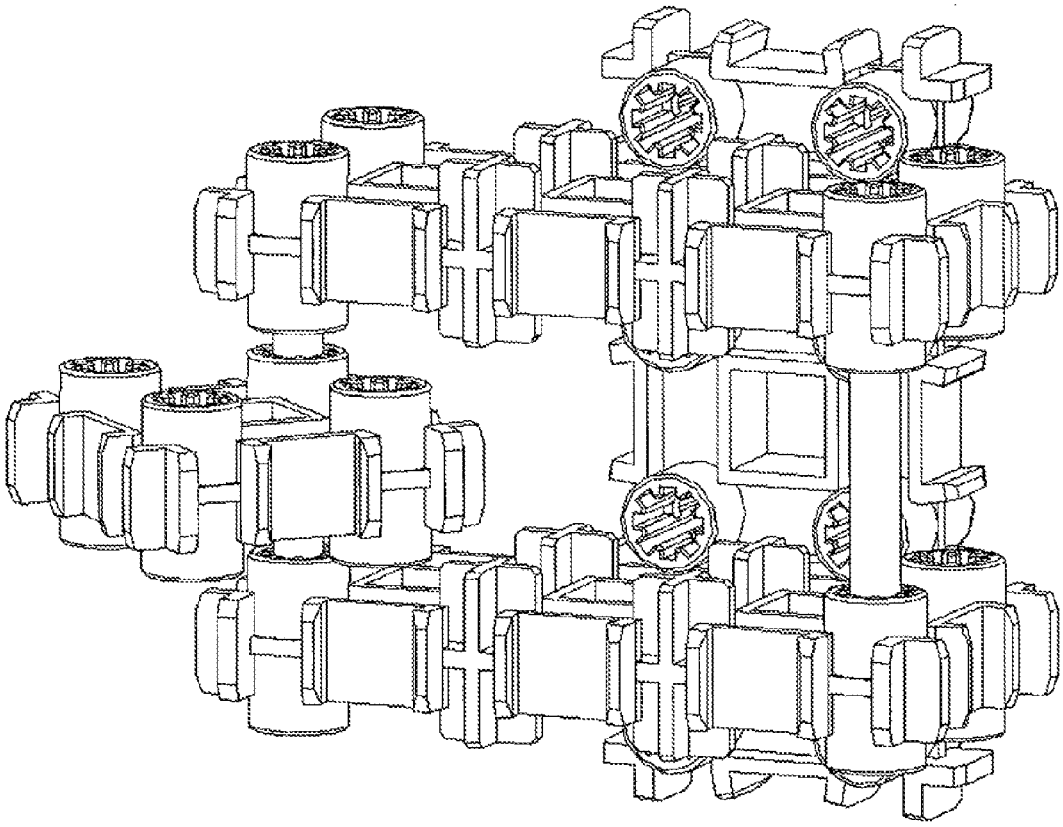

FIG. 17 shows a set of constructor elements prior to being assembled into a construction, shown in FIGS. 20 and 21.

Protrusions of interlocking joints, for a more precise positioning of constructor elements during connection with each other, can be implemented with bevels, rounded off, sloped, and so forth. The base 1 can also be made with various openings to conserve materials.

What is claimed is:

1. A constructor element, comprising:

a flat base having a rectangular form having opposing planar sides, rectangular side edges of the base each having a length in multiples of a; and an interlocking joint comprising four distinct groups of protrusions integrally formed on the base;

wherein a first group comprises a plurality of first protrusions perpendicularly extending from each planar side of the base, each with a height greater than 0.5a, but not more than a, each first protrusion being tubular with a ring-shaped cross-section with an outer diameter equal to a;

a second group comprising a plurality of second protrusions perpendicularly extending from each planar side of the base, each with a height equal to 0.5a, each second protrusion being tubular with a cross-section in a form of a square having a side length of the square tubular protrusion equal to a;

a third group comprising a plurality of third protrusions perpendicularly extending from each planar side of the base, each in a form of a planar rectangular plate positioned with its midline extending along a respective side edge of the base with a width equal to a, flush with the side edge, each third protrusion having, along opposing short sides of the rectangular plate perpendicular to the base, opposing ledges outwardly extending from the base along a respective short side of the rectangular plate, protruding not more than 0.5a from the base side edges and angled towards each other with a gap formed between their end parts no greater than a; and a fourth group comprising a plurality of fourth protrusions perpendicularly extending from each planar side of the base, each made in a form of a corner comprising a pair of perpendicular planar shelves, each shelf positioned perpendicular to the plane of the base and coplanar with a respective adjacent side edge of the base, and having a length equal to a and a width not greater than 0.5a;

wherein all protrusions are positioned on the base in accordance with a coordinate grid of mutually perpendicular lines parallel to the base side edges and defining grid cells, wherein a distance between neighboring lines on the coordinate grid equal to 2a, a distance between respective base side edges and neighboring lines on the coordinate grid is 0.5a; and wherein the protrusions from the first group are positioned at points where coordinate grid lines intersect, the protrusions from the second group are positioned at points where diagonals of the cells of the coordinate grid intersect, the protrusions from the third group are positioned in a middle between neighboring protrusions from the first group that are positioned flush with the side edges of the base, and the protrusions from the fourth group are positioned at the corners of the base.

2. The constructor element according to claim 1, characterized b at least one protrusion from the first group having at least one groove on an inner side.

3. The constructor element according to claim 1, characterized by at least one protrusion from the first group having at least two grooves on an inner side.

4. The construct or element according to claim 3, characterized by the grooves being made diametrically opposite.

5. The constructor element according to claim 2, characterized by at least one groove made ported.

6. A constructor element, comprising:

a flat base having a rectangular form having opposing planar sides, at least one rectangular side edge with a length equal to a, and other side edge is a multiple of a; and an interlocking joint comprising three distinct groups of protrusions integrally formed on the base;

wherein a first group comprises a plurality of first protrusions perpendicularly extending from each planar side of the base, each with a height greater than 0.5a, but not more than a, each first protrusion being tubular with a ring-shaped cross-sections with an outer diameter equal to a;

a second group comprising a plurality of second protrusions perpendicularly extending from each planar side of the base, each in a form of a planar rectangular plate positioned with its midline extending along a respective side edge of the base with a width equal to a, flush with the side edge, each third protrusion having, along opposing short sides of the rectangular plate perpendicular to the base, opposing ledges outwardly extending from the base along a respective short side of the rectangular plate, protruding not more than 0.5a from the base side edges and angled towards each other with a gap formed between their end parts no greater than a; and a third group comprising a plurality of third protrusions perpendicularly extending from each planar side of the base, each made in a form of a corner comprising a pair of perpendicular planar shelves, each shelf positioned perpendicular to the plane of the base and coplanar with a respective adjacent side edge of the base, and having a length equal to a and a width not greater than 0.5a;

wherein all protrusions are positioned on the base in accordance with a coordinate grid of mutually perpendicular lines parallel to the base side edges and defining grid cells, wherein a distance between neighboring lines on the coordinate grid equal to 2a, a distance between respective base side edges and neighboring lines on the coordinate grid is 0.5a; and wherein the protrusions from the first group are positioned at points where coordinate grid lines intersect, the protrusions from the second group are positioned in a middle between neighboring protrusions from the first group that are positioned flush with the side edges of the base, and the protrusions from the third group are positioned at the corners of the base.

7. The constructor element according to claim 6, characterized by at least one protrusion from the first group having at least one groove on an inner side.

8. The constructor element according to claim 6, characterized by at least one protrusion from the first group having at least two grooves on an inner side.

9. The constructor element according to claim 8, characterized by the grooves being made diametrically opposite.

10. The constructor element according to claim 7, characterized by at least one groove made ported.

11. A constructor element, comprising:

a flat base having a rectangular form having opposing planar sides, rectangular sides edges of the base each having a length in multiples of a; and an interlocking joint comprising four distinct groups of protrusions integrally formed on the base;

wherein a first group comprises a plurality of first protrusions perpendicularly extending from each planar side of the base, each with a height greater than 0.5a, but not more than a, at least one first protrusion comprising a cross-shaped cross-section, where a distance between opposing ends of each leg of the cross is equal to a, and at least one first protrusion being tubular with a ring-shaped cross-sections with an outer diameter equal to a;

a second group comprising a plurality of second protrusions perpendicularly extending from each planar side of the base, each with a height equal to 0.5a, each second protrusion being tubular with a cross-section in a form of a square having a side length of the square tubular protrusion equal to a;

a third group comprising a plurality of third protrusions perpendicularly extending from each planar side of the base, each in a form of a planar rectangular plate positioned with its midline extending along a respective side edge of the base with a width equal to a, flush with the side edge, each third protrusion having, along opposing short sides of the rectangular plate perpendicular to the base, opposing ledges outwardly extending from the base along a respective short side of the rectangular plate, protruding not more than 0.5a from the base side edges and angled towards each other with a gap formed between their end parts no greater than a; and a fourth group comprising a plurality of fourth protrusions perpendicularly extending from each planar side of the base, each made in a form of a corner comprising a pair of perpendicular planar shelves, each shelf positioned perpendicular to the plane of the base and coplanar with a respective adjacent side edge of the base, and having a length equal to a and a width not greater than 0.5a;

wherein all protrusions are positioned on the base in accordance with a coordinate grid of mutually perpendicular lines parallel to the base side edges and defining grid cells, wherein a distance between neighboring lines on the coordinate grid equal to 2a, a distance between respective base side edges and neighboring lines on the coordinate grid is 0.5a;

wherein the protrusions from the first group are positioned at points where coordinate grid lines intersect, respective ends of the crosses which are adjacent a side edge of the base are flush with the side edges of the base, the protrusions from the second group are positioned at points where diagonals of the cells of the coordinate grid intersect, the protrusions from the third group are positioned in a middle between neighboring protrusions from the first group that are positioned flush with the side edges of the base, and the protrusions from the fourth group are positioned at the corners of the base.

12. The constructor element according to claim 11, characterized at least one protrusion with the ring-shaped cross-section from the first group having at lease one groove on an inner side.

13. The constructor element according to claim 11, characterized by at least one protrusion with the ring-shaped cross-section from the first group having at least two grooves on an inner side.

14. The constructor element according to claim 13, characterized by the grooves being made diametrically opposite.

15. The constructor element according to claim 12, or 14, characterized by at least one groove made ported.

16. A constructor element, comprising:

a flat base having a rectangular form having opposing planar sides, at least one rectangular side edge with a length equal to a, and other side edge is a multiple of a; and an interlocking joint comprising three distinct groups of protrusions integrally formed on the base;

wherein a first group comprises a plurality of first protrusions perpendicularly extending from each planar side of the base, each with a height greater than 0.5a, but not more than a, at least one first protrusion comprising a cross-shaped cross-section, where a distance between opposing ends of each leg of the cross is equal to and at least one first protrusion being tubular with a ring-shaped cross-section with an outer diameter equal to a;

a second group comprising a plurality of second protrusions perpendicularly extending from each planar side of the base, each in a form of a planar rectangular plate positioned with its midline extending along a respective side edge of the base with a width equal to a, flush with the side edge, each third protrusion having, along opposing short sides of the rectangular plate perpendicular to the base, opposing ledges outwardly extending from the base along a respective short side of the rectangular plate, protruding not more than 0.5a from the base edges and angled towards each other with a gap formed between their end parts no greater than a; and a third group comprising a plurality of third protrusions perpendicularly extending from each planar side of the base, each made in a form of a corner comprising a pair of perpendicular planar shelves, each shelf positioned perpendicular to the plane of the base and coplanar with a respective adjacent side edge of the base, and having a length equal to a and a width not greater than 0.5a;

wherein all protrusions are positioned on the base in accordance with a coordinate grid of mutually perpendicular lines parallel to the base side edges and defining grid cells, wherein a distance between neighboring lines on the coordinate grid equal to 2a, a distance between respective base side edges and neighboring lines on the coordinate grid is 0.5a; and wherein the protrusions from the first group are positioned at points where coordinate grid lines intersect, respective ends of the crosses which are adjacent a side edge of the base are flush with the side edges of the base, and at least one of the protrusions with the ring-shaped cross-sections has grooves on an inner side, at least one of which is made ported, the protrusions from the second group are positioned in a middle between neighboring protrusions from the first group that are positioned flush with the side edges of the base, and the protrusions from the third group are positioned at the corners of the base.

17. The constructor element according to claim 16, characterized by the grooves being made diametrically opposite.

18. A constructor, comprising:

three types of constructor elements, implemented with an ability to connect to one another and form a single construction;

wherein constructor elements of a first type comprise:

a flat base having a rectangular form having opposing planar sides, rectangular side edges of the base each having a length in multiples of a; and an interlocking joint comprising four distinct groups A of protrusions integrally formed on the base;

wherein a first group A comprises a plurality of first protrusions perpendicularly extending from each planar side of the base, each with a height greater than 0.5a, but not more than a, at least one first protrusion comprising a cross-shaped cross-section, where a distance between opposing ends of each leg of the cross is equal to a, and at least one first protrusion being tubular with a ring-shaped cross-section with an outer diameter equal to a;

a second group A comprising a plurality of second protrusions perpendicularly extending from each planar side of the base, each with a height equal to 0.5a, each second protrusion being tubular with a cross-sections in a form of a square having a side length of the square tubular protrusion equal to a;

a third group A comprising a plurality of third protrusions perpendicularly extending from each planar side of the base, each in a form of a planar rectangular plate positioned with its midline extending along a respective side edge of the base with a width equal to a, flush with the side edge, each third protrusion having, along opposing short sides of the rectangular plate perpendicular to the base, opposing ledges outwardly extending from the base along a respective short side of the rectangular plate, protruding not more than 0.5a from the base side edges and angled towards each other with a gap formed between their end parts no greater than a; and a fourth group A comprising a plurality of fourth protrusions perpendicularly extending from each planar side of the base, each made in a form of a corner comprising a pair of perpendicular planar shelves, each shelf positioned perpendicular to the plane of the base and coplanar with a respective adjacent side edge of the base, and having a length equal to a and a width not greater than 0.5a;

wherein all protrusions are positioned on the base in accordance with a coordinate grid of mutually perpendicular lines parallel to the base side edges and defining grid cells, wherein a distance between neighboring lines on the coordinate grid equal to 2a, a distance between respective base side edges and neighboring lines on the coordinate grid is 0.5a;

wherein the protrusions from the first group A are positioned at points where coordinate grid lines intersect, respective ends of the crosses which are adjacent a side edge of the base are flush with the side edges of the base, the protrusions from the second group A are positioned at points where diagonals of the cells of the coordinate grid intersect, the protrusions from the third group A are positioned in a middle between neighboring protrusions from the first group A that are positioned flush with the side edges of the base, and the protrusions from the fourth group A are positioned at the corners of the base;

wherein constructor elements of a second type comprise:

a flat base having a rectangular form having opposing planar sides, at least one rectangular side edge with a length equal to a, and other side edge is a multiple of a; and an interlocking joint comprising three distinct groups B of protrusions integrally formed on the base;

wherein a first group B comprises a plurality of first protrusions perpendicularly extending from each planar side of the base, each with a height greater than 0.5a, but not more than a, at least one first protrusion comprising a cross-shaped cross-section, where a distance between opposing ends of each leg of the cross is equal to a and at least one first protrusion being tubular with a ring-shaped cross-section with an outer diameter equal to a;

a second group B comprising a plurality of second protrusions perpendicularly extending from each planar side of the base, each in a form of a planar rectangular plate positioned with its midline extending along a respective side edge of the base with a width equal to a, flush with the side edge, each third protrusion having, along opposing short sides of the rectangular plate perpendicular to the base, opposing ledges outwardly extending from the base along a respective short side of the rectangular plate, protruding not more than 0.5a from the base side edges and angled towards each other with a gap formed between their end parts no greater than a; and a third group B comprising a plurality of third protrusions perpendicularly extending from each planar side of the base, each made in a form of a corner comprising a pair of perpendicular planar shelves, each shelf positioned perpendicular to the plane of the base and coplanar with a respective adjacent side edge of the base, and having a length equal to a and a width not greater than 0.5a;

wherein all protrusions are positioned on the base in accordance with a coordinate grid of mutually perpendicular lines parallel to the base side edges and defining grid cells, wherein a distance between neighboring lines on the coordinate grid equal to 2a, a distance between respective base side edges and neighboring lines on the coordinate grid is 0.5a; and wherein the protrusions from the first group B are positioned at points where coordinate grid lines intersect, respective ends of the crosses which are adjacent a side edge of the base are flush with the side edges of the base, the protrusions from the second group B are positioned in a middle between neighboring protrusions from the first group B that are positioned flush with the side edges of the base, and the protrusions from the third group B are positioned at the corners of the base;

wherein, elements of the first and/or second type have protrusions with the ring-shaped cross-sections from the first group A and/or B implemented with grooves on an inner side; and wherein constructor elements of a third type are made tubular and/or rod-shaped and are each equipped with at least one protrusion on a side surface thereof with an ability to longitudinally move the constructor elements of the third type into the grooves of the protrusions with the ring-shaped cross-section.

19. The constructor according to claim 18, characterized by the grooves made diametrically opposite.

* * * * *